United States Patent [19]

Maier et al.

[11] Patent Number: 4,545,632

[45] Date of Patent: Oct. 8, 1985

[54] MODULAR ELECTRICAL DISTRIBUTION CONNECTION SET

[75] Inventors: Gernot Maier, Stuttgart; Heinrich Tischler, Gerlingen; Rolf Wöhr, Leonberg; Wolfgang Schwarzhoff, Lüdenscheid, all of Fed. Rep. of Germany

[73] Assignee: Robert Bosch GmbH, Stuttgart, Fed. Rep. of Germany

[21] Appl. No.: 553,710

[22] Filed: Nov. 21, 1983

[30] Foreign Application Priority Data

Nov. 26, 1982 [DE] Fed. Rep. of Germany ..... 3243727

[51] Int. Cl.[4] ..... H01R 29/00

[52] U.S. Cl. ..... 339/18 R; 339/38; 339/92 M; 339/94 M; 339/113 L; 339/157 R; 339/176 M

[58] Field of Search ..... 339/176 M, 94 M, 38, 339/92 M, 18 R, 18 C, 18 B, 18 P, 113 R, 113 L, 198 R, 157 R, 157 C, 170

[56] References Cited

U.S. PATENT DOCUMENTS

| | | | |
|---|---|---|---|
| 995,674 | 6/1911 | Hertzberg et al. | 339/159 R |
| 2,761,111 | 8/1956 | Klostermann | 339/94 R |
| 2,932,811 | 4/1960 | Abraham et al. | 339/38 |
| 3,291,925 | 12/1966 | Hartsock | 339/18 R |
| 3,820,056 | 6/1974 | Ayer | 339/198 R |
| 4,109,989 | 8/1978 | Snyder, Jr. et al. | 339/94 M |
| 4,179,179 | 12/1979 | Lowden | 339/92 M |
| 4,303,296 | 12/1981 | Spaulding | 339/198 R |
| 4,397,511 | 8/1983 | Clark et al. | 339/113 R |

FOREIGN PATENT DOCUMENTS

| | | | |
|---|---|---|---|
| 2132123 | 1/1973 | Fed. Rep. of Germany | 339/176 M |
| 2554619 | 6/1976 | Fed. Rep. of Germany | 339/159 R |
| 1393059 | 5/1975 | United Kingdom | 339/198 R |
| 1429692 | 3/1976 | United Kingdom | 339/38 |
| 2045546 | 10/1980 | United Kingdom | 339/113 R |

*Primary Examiner*—John McQuade

*Attorney, Agent, or Firm*—Frishauf, Holtz, Goodman & Woodward

[57] ABSTRACT

The set contains a central distribution box (20) having a plurality of severable electrical main terminals, for example connectable by a cable or by internal wiring to a distribution panel by, for example, a connector (22) or internal wiring. A plurality of identical adjacently located multi-terminal connection sockets (21) are located at the sides of the distribution box. The socket or receptacle terminals of the sockets (21) are internally connected to the main terminals by electrical connections on a conductor support plate. For modular use, and flexibility, a plurality of identical, severable plug units (38, 51) having projecting prongs (40, 53) located in the pattern of the receptacle or socket terminals, are engageable with the receptacle or socket terminals, some of the plug units including, in a common housing, distribution strips secured thereto and having, within the housing, and internal distribution connecting plate and conductors thereon, for attachment to further sockets (50) which may have a lesser number of connectors than the prongs on the plug units. Typically, the prongs of the plug units have seven connectors, the distribution sockets only four, one of each of the connectors being grounded. To insure vibration-proof reliable connections, the plug units and the sockets are formed with interengaging threaded sleeves and screws, the screws being axially retained, for example by a T ring, to insure positive ejection of the plugs upon rotation of the screws in removing direction.

14 Claims, 23 Drawing Figures

XV
XV
72
72
44
39
35
38
40
40
41
42
39
35
44
43
41
42
35
39
38
40
40

MODULAR ELECTRICAL DISTRIBUTION CONNECTION SET

The present invention relates to a modular electrical distribution connection set, and more particularly to a modular set which readily lends itself for expansion and to connect, for example, motors and the like at selected locations without requiring individual wiring.

BACKGROUND

Individual wiring of loads from a load center is well known and the subject of most electrical installations. When multiple loads are to be connected to a single load center, it is frequency difficult to maintain supervision and visibility of the respective connections, so that possible misconnections can be easily determined, and changes, if required, can be easily made. Rewiring distribution panels for connection of additional loads is, frequently, expensive and requires skilled work.

THE INVENTION

It is an object to provide a modular set which permits ready connection of multiple loads simply and without requiring skilled installation work.

Briefly, a plurality of mutually matched plug modules and socket modules are associated with a distribution box, in which the plug modules have connection prongs positioned in a predetermined pattern, socket modules have connection receptacles positioned in a predetermined pattern, and, preferably, a supply plug is provided, fitting in a matching supply socket, the internal connections within the distribution box all being retained on a common connector plate, which, for example, carries all the distribution connections, such as buses, wiring strips, and the like.

The system of the invention has the advantage that the respective plug modules can be provided as completely wired, pre-manufactured elements which only need to be assembled as desired. The set can be connected directly to a distribution box, or the like, or may be located remotely therefrom, for example adjacent equipment to be powered. The plugs and sockets contain multiple connection elements and are matched to each other so that the interconnection will be properly polarized and can be easily effected, rapidly, and without connecting errors. This has the substantial additional advantage that connection of further load elements, such as motors and the like, can be effected by merely placing a cable and a connector, without requiring special wiring by electricians. This arrangement, thus, has the advantage that a machine, or other load to be installed, can be supplied with an installation diagram in which only the respective connecting modules need be identified. It is then only necessary to place the appropriate connecting modules in accordance with the connection diagram, and additional wiring can be avoided. The system is characterized by being particularly easy to visually supervise and check any connections. Maintenance is particularly simple.

DRAWINGS

DETAILED DESCRIPTION

Figure 1:
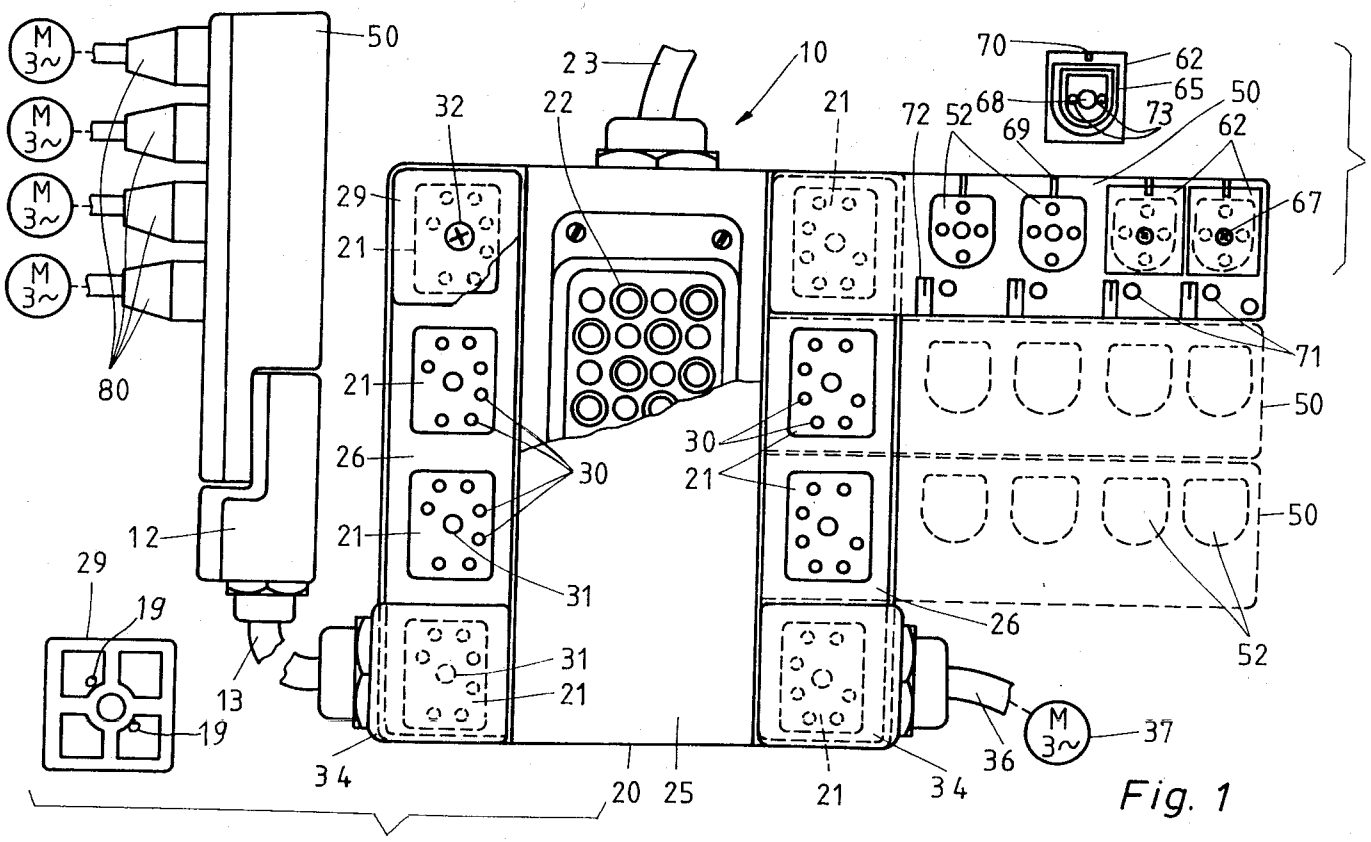
FIG. 1 is a partly exploded schematic illustration of the electrical modular set, in which some elements are interconnected, and others are shown separately, in exploded representation.
Figure 23:
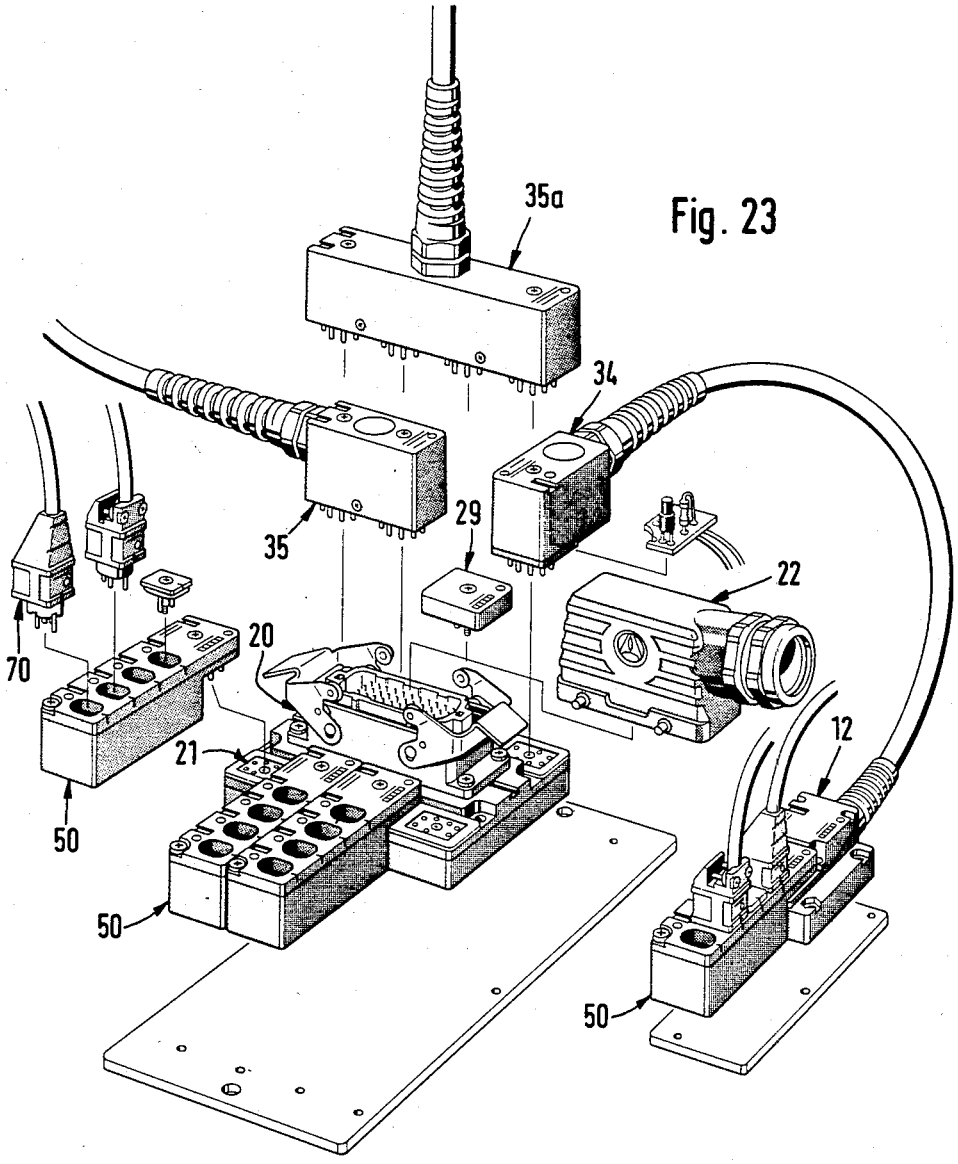
FIG. 23, is a perspective, exploded view of the electrical modular set.

The connection set 10 of FIGS. 1 and 23 illustrates the connected use of all single modules of the system or set of the present invention. All modules which form part of the set 10 are mutually matched plug modules and socket modules. The plug modules have fitting plug elements which have connection or contact prongs, such as circular pins, spade or blade connectors, or the like. They may, additionally, have connecting elements which are formed with plug elements or socket elements for connection to suitable plugs or sockets.

Figure 3:
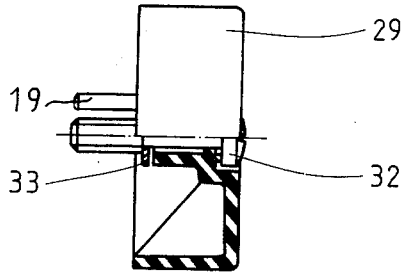
FIG. 3 is a part-sectional view of FIG. 2, cut along the broken section line III—III.
Figure 4:
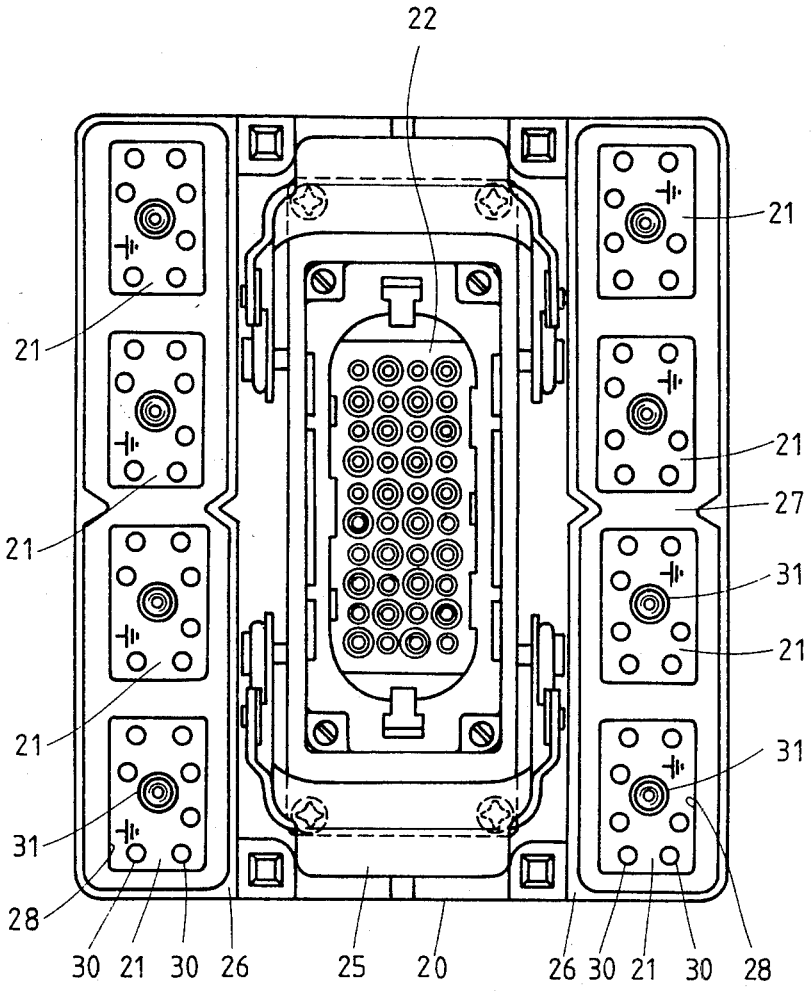
FIG. 4 is a top view of the distribution plug-in element, to an enlarged scale.
Figure 5:
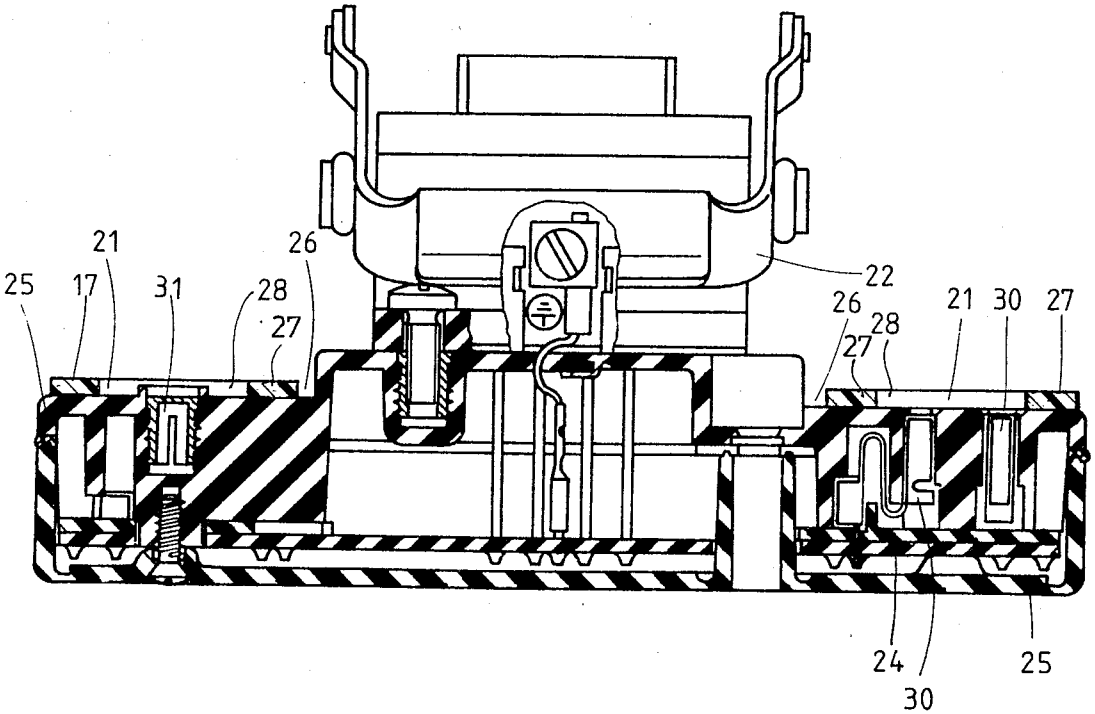
FIG. 5 is a transverse sectional view of the distribution plug of FIG. 4.

The central element of the set 10 is formed by a plug distributing element 20 which, overall, has eight plugs 21, each with seven terminal elements, forming receptacles for plugs, and a connection plug 22—or a corresponding socket—with forty terminals, which is common to all sockets 21. The forty-terminal plug 22—or the corresponding socket—is located in the center, between two parallel rows of four sockets 21, respectively. The connecting plug 22 is of customary well-known design. A plug connector of customary construction can be inserted in the connector plug 22, having appropriate connection terminals to match the element 22, connectable over a cable, or by fixed wiring with a suitable distribution panel. The distribution panel and the wiring thereto have been omitted from the drawing since they are conventional. Alternatively, and as shown in FIG. 1, the connector 22 may be connected directly by a cable 23 to an external supply, such as a distribution box, so that cable 23 can be wired directly into the distribution plug 20. The connections of the connecting plug 22, as well as the connections of all the eight plugs or receptacles 21, are secured to and interconnected on a common conductor plate or carrier 24 (FIG. 5). The distribution plug 20 has a housing 25 which, preferably, is made of plastic. At its top side it has a continuous sealing element 27, for example adhered thereto, suitable to seal four plug or receptacle units 21 with one sealing strip. The seal 27 has a recess 28, preferably essentially of square configuration, in plan view (see FIG. 4) to expose the respective elements of the receptacles or sockets 21. Each one of the receptacles 21 associated with the distribution plug 20 has a protective cap 29—see FIG. 3—associated therewith. If any one of the plugs or receptacles 21 are not needed, the cap 29, which is roughly rectangular, is secured thereto and, upon compression of seal 27, provides for humidity or water-tight seal and such other sealing as may be required. Two centering pins 19, for example diametrically located, engage in two matching contact bushings 30 to insure reliable seating of the sealing caps.

Figure 2:
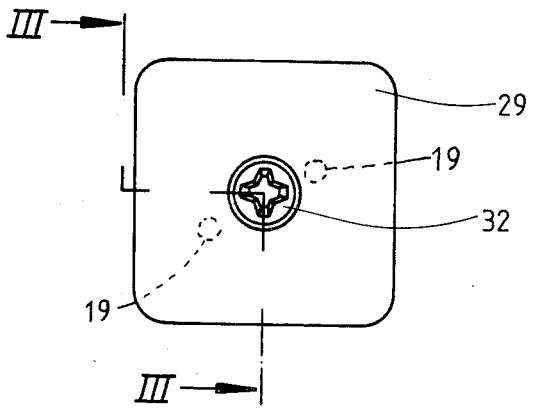
FIG. 2 is a top view of a protecting cap.

The respective terminal bushings or receptable elements 30 (see FIGS. 4, 5) of the various receptacles or sockets 21 are located within a housing 25 and terminate short of the upper side 26 of the housing 25—see FIG. 5. Seven terminal bushings or receptacle sleeves 30 are provided for each one of the receptacles or sockets 21 of the plug distributor 20; they are located along the circumference of a rectangle—see FIGS. 1 and 4—at suitable locations to permit insertion of plugs in only one oriented arrangement. The center of each one of the plugs includes a fixed threaded sleeve 31 (FIG. 5). The receptacles 21 are closed by the cover caps 29 (FIG. 2) when not in use; if so closed, a screw 32 (FIG. 3) retained in each one of the caps 29 engages in the threaded portion 31. When the screw 32 is tightened, the seal 27 is compressed and the protective cap 29 is sealingly retained on the housing wall 25, completely sealing the respective socket or receptacle element 21. Screw 32 is retained by a C-ring 33 to prevent axial shifting thereof, and loss from the cap 29.

The modular set includes a remote socket, or coupling element 12—see FIGS. 1 and 16–18—which includes an electrical cable 13 (FIG. 1). The cable 13 is omitted from the illustrations of FIGS. 16–18 for clarity. The cable is led through an opening 14 into the interior of the housing 15 of the respective coupling, for attachment therein, and electrical connection to the electrical terminals. The coupling 12 has a seven-terminal socket 21 forming a plug receptacle, which is identically constructed to the sockets 2 of the plug distributor 20. A seal 27 extends around the socket openings of the socket portion 21, which is identically constructed to the seal 27, about each one of the sockets 21. A fixed threaded bushing 31 is located, similarly, in the center of the respective connecting sleeves or other equivalent engagement elements. It is, thus, possible to close off the socket 21 of the coupling 12, if desired, by cover caps 29, if the specific socket is not needed. Alternatively, a plug is introduced into the socket 21, the plug being secured by screwing a threaded bolt or screw into the bushing 31. Since the plug element 21 of the coupling 12 and the respective single elements thereof are identical to the plug elements 21 of the plug distributor 20, the same reference numerals have been used to clarify that the construction and arrangement of the sockets or receptacles of the plug distributor 20 are identical to the arrangement of the sockets 21 of the coupling 12.

The set further includes adapter elements 34 (FIG. 1), 35 and 35*a* (FIGS. 12–15, 23). The adapter element 34 has a seven-terminal plug with projecting seven-terminal contact prongs extending from the housing of the adpater. The adapter element 34 has an electrical supply connection which, in the example of FIG. 1, is the cable 13 which leads to the coupling 12. It may, also, form a cable 36 which leads to a motor 37, shown only in schematic form. The single adapter element 34 with the seven-terminal plug can be inserted in an associated seven-terminal socket or receptacle 21 of the plug distributor 20.

The adapter element 35 (see FIGS. 12 to 15) has two or four similarly constructed plugs 38. The plugs 38 are all identical. Each one has seven projecting prongs extending from the adaptor housing 39. The connecting prongs 40 of each plug 38 are grouped along a rectangular configuration—see FIG. 13—so that the contact prongs 40 of a plug 38, upon attachment of an adapter element 34, or 35, respectively, to the plug distributor 20 will fit exactly into the receptacle elements of the receptacles or sockets 21, or, respectively, fit exactly into the receptacles or sockets of two adjacent sockets 21. The dual or tandem adapter element then be arranged in parallel to the row of four sockets 21 of the distributor 20. The adapter 38, in the center of the respective prongs, retains a screw or bolt 41 which, when the respective adapter 38 is inserted in the socket 21, can be screw-connected with an associated threaded sleeve or bushing 31 in the respective socket 21. Upon tightening of the screw 41, the respective adapter element is secured in connected position. The screw 41 has a C-ring which retains it in axially predetermined location and prevents loss thereof.

Upon separation of the adapter element 35 from the plug distributor 20, screws 41 will push out the respective adapter element due to the presence of the C-ring 42, so that the adapter element 35 with the contact prongs 40 is loosened from the contact sleeves or engagement elements 30 of the respective socket 21 of the plug distributor 20 until the threaded portion of screw 41 loses threaded engagement with the internally threaded sleeve or bushing 31 in the socket. This forcible ejection of the adapter 35, upon unscrewing the screws 41, substantially facilitates removal of the adapter and prevents skewing or bending of the contact prongs 40, both upon insertion and removal, particularly when being handled by unskilled or careless personnel.

The single adapter element 34 (FIG. 1) has only a single plug 38 with seven contact prongs 40. The dual adapter element 35, see FIGS. 12–15, has two similar plugs 38 in a single housing. The electrical connection can be made, selectively, at two different positions of the housing 39, by being introduced thereto as desired. Circular housing portions 43, 44, respectively—see FIG. 12—may be preformed as break-out connections. Internal clamping or holding elements for cable components and the like have been omitted since they can be standard and in accordance with any well-known construction.

The set 10 includes, as a particularly desirable and important element, a plug strip 50 (FIGS. 1, 6, 7) which has a seven-terminal plug 51 which is identical to the plug 38 of the adapter element 35 and, further, four 4-terminal power distribution sockets or receptacles 52. The 4-terminal receptacles 52 are constructed as plug-in receptacles of unique type to receive specifically matched plugs 80 (FIGS. 19–22). The plug 51 is identical in its construction and in the arrangement of the contact prongs 53 to the plugs 38 of the adapter element 35. A screw 54—FIG. 7—is located in the center of the outline of the contact prongs 53 which, at its end portion, is formed with a threaded section and which is held by a C-ring 55 axially in predetermined position, and thereby insured against loss. The plug strip 50 can be inserted with its plug 51 into any one of the receptacles 21 of the plug distributor 20. The plug strip 50 is so arranged that it extends at approximately right angle, in a row, with respect to the four receptacles 21. This is illustrated in FIG. 1, where a strip 50 extends to the right at right angles from the topmost socket 21. Other strips 50 can be inserted in others of the sockets 21, as shown in broken-line arrangement, or can be placed on the left side, as desired.

Sockets 52 and the four plugs 51 of the strip 59 are located in an extending line, next to each other, in this arrangement:

All terminals of the sockets 52 as well as of the plug 51 are connected to a common conductor plate 56 which includes a flexible conductor element 57, bridging a stepped arrangement. The contact prongs 53 of the plug 51 extend outwardly of the housing 58 from one side thereof. The four sockets 51 are located on the opposite side of the housing 58 and are reset therein. Each one of the sockets 52 has a receptacle well 59 in advance thereof, in which the respective connecting plugs 80 can be fitted. The 4-terminal sleeves or receptacle elements 60 of each socket 52 are located, generally, in a cross configuration—see FIG. 6—and symmetrically grouped. A fixed threaded bushing 61 is located centrally in each one of the sockets 52.

Figure 6:
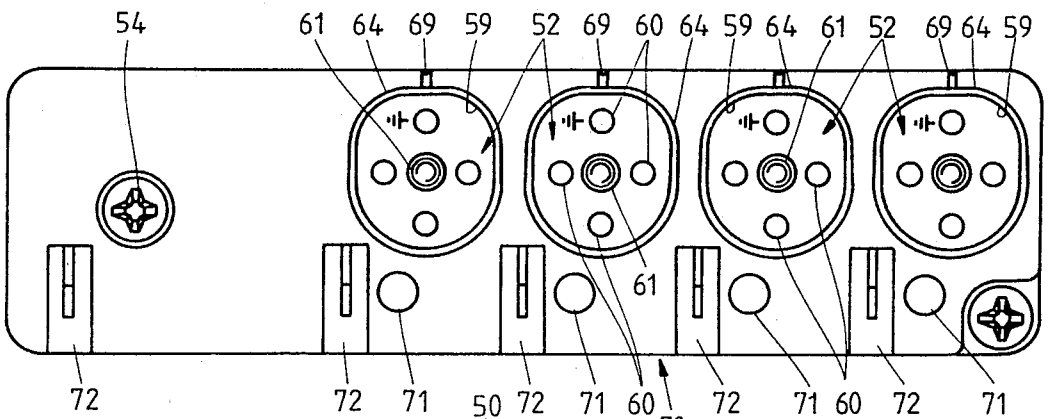
FIG. 6 is a top view, to an enlarged scale, of a plug-in strip.
Figure 7:
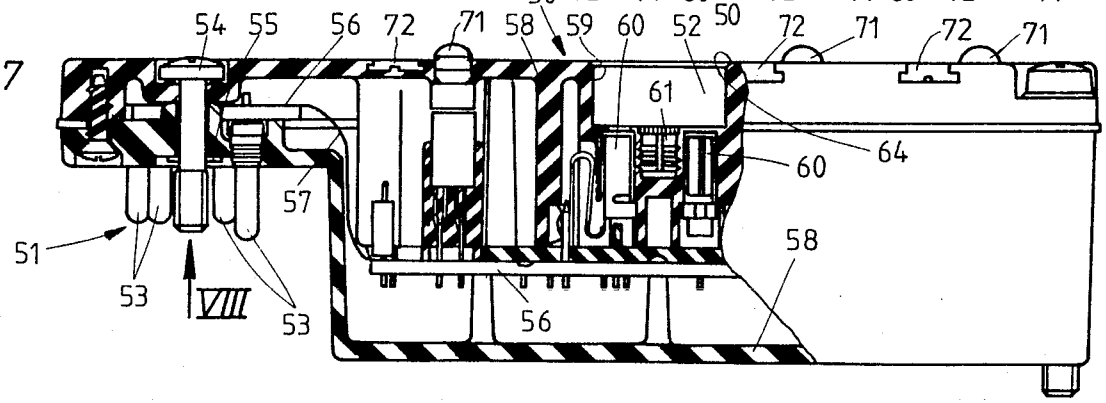
FIG. 7 is a partially sectional view of the strip of FIG. 6.
Figure 10:
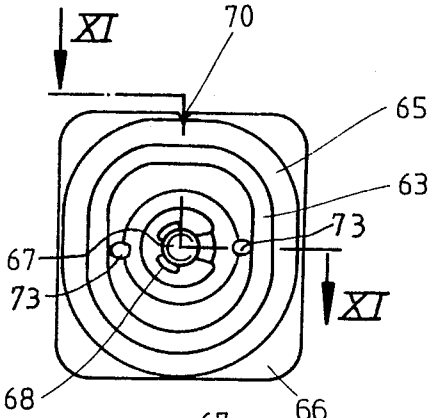
FIG. 10 is a rear view of the plug element of FIG. 9.
Figure 9:
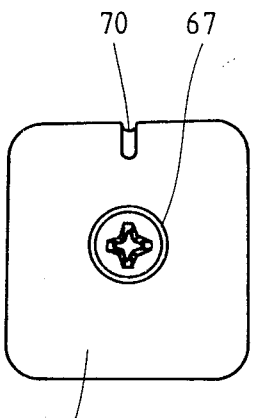
FIG. 9 is a front view of a cover cap for a plug element.
Figure 8:
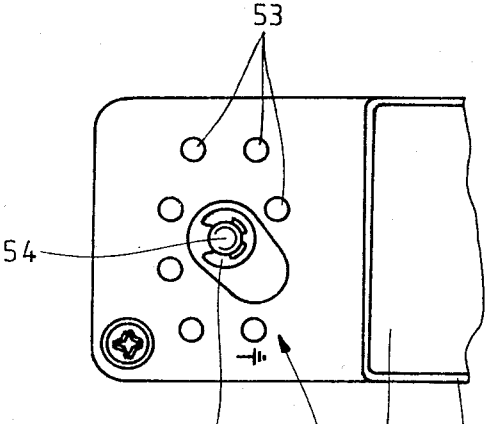
FIG. 8 is a fragmentary view of FIG. 7 in the direction of the arrow VIII in FIG. 7.
Figure 11:
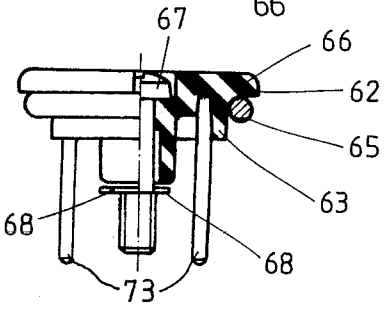
FIG. 11 is a side view, partially sectioned, along the broken section line XI—XI of FIG. 10, of the plug of FIG. 9.
Figures 12, 13, 14:
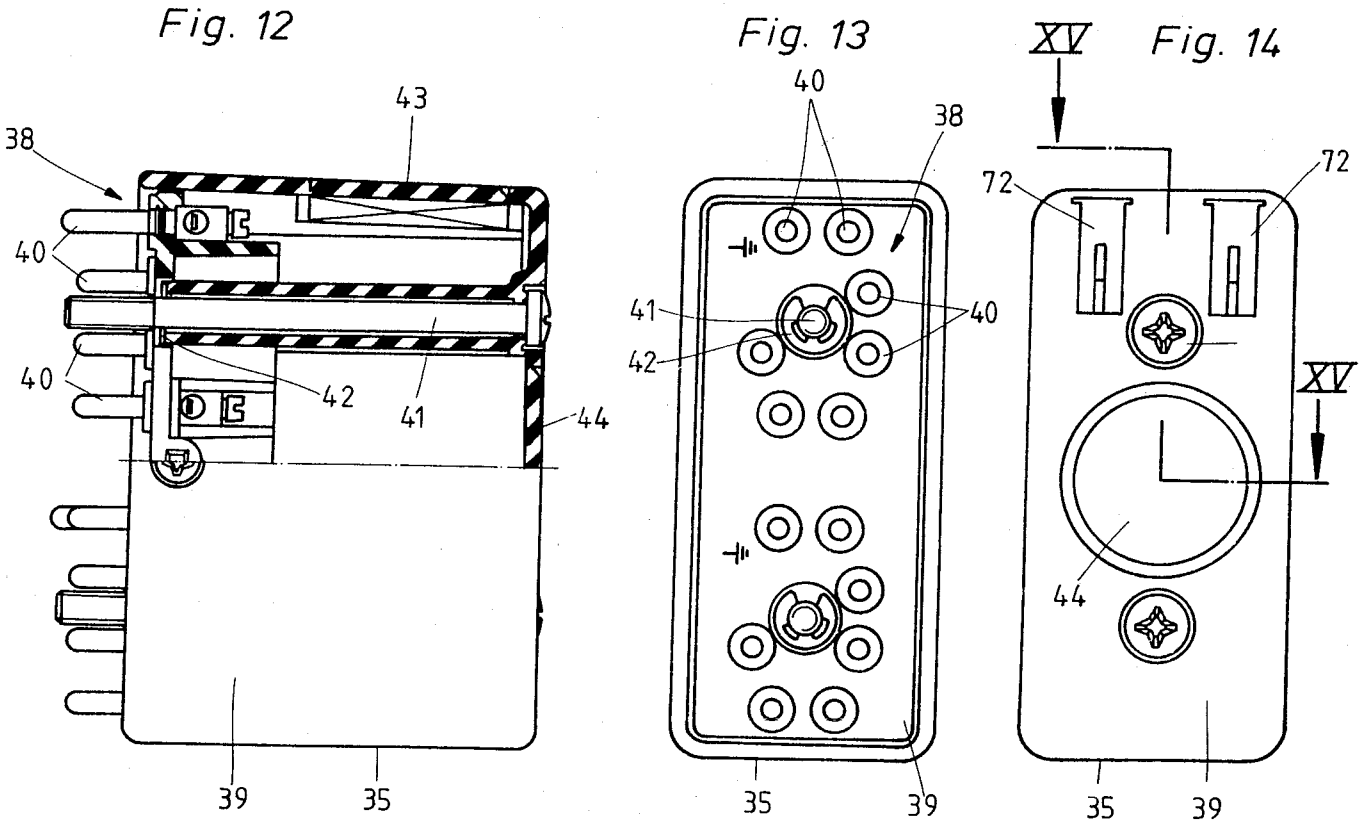
FIG. 12 is a partially sectional view of a two-way adapter element.
FIG. 13 is a front view of the element of FIG. 12.
FIG. 14 is a rear view of the adapter of FIG. 12.
Figure 15:
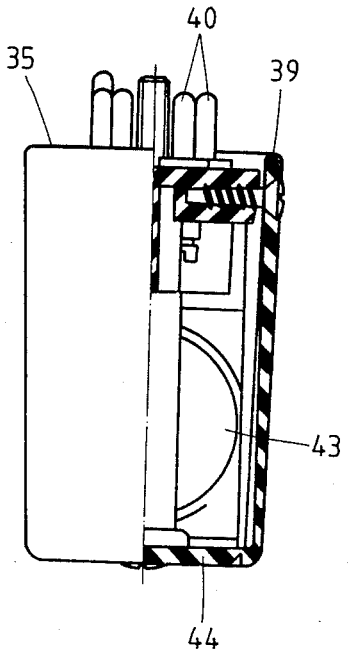
FIG. 15 is a fragmentary sectional view along line XV—XV of FIG. 14.
Figure 16:
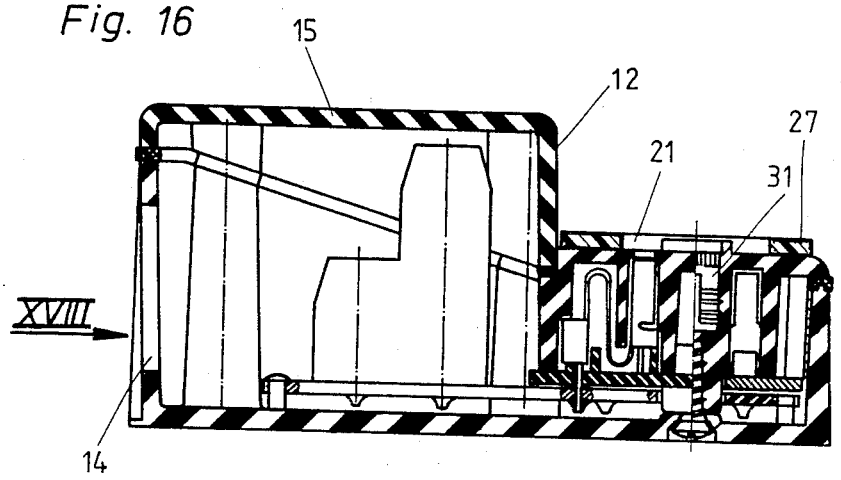
FIG. 16 is a section through a coupling element of the set.
Figure 18:
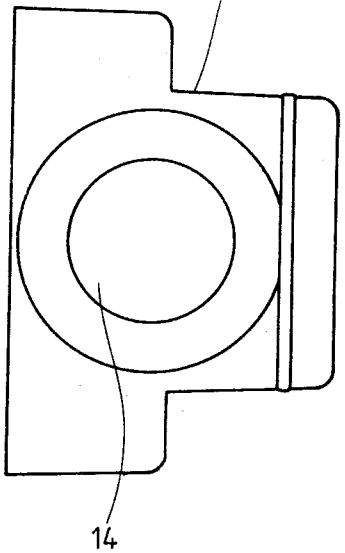
FIG. 18 is a side view of the coupling element of FIG. 16, taken in the direction of arrow XVIII of FIG. 16.
Figure 17:
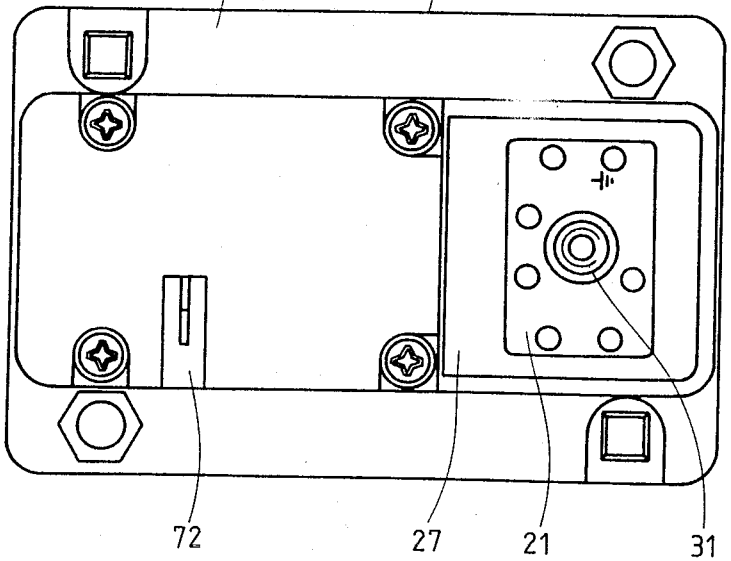
FIG. 17 is a top view of the coupling element of FIG. 16.
Figure 19:
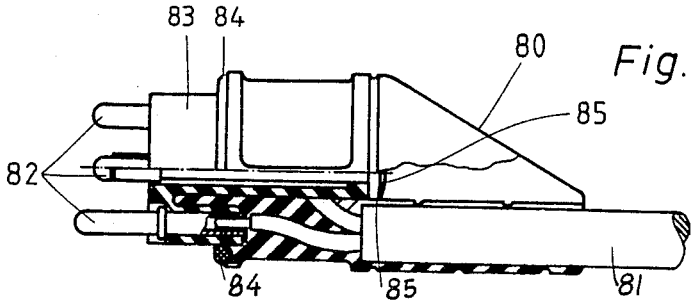
FIG. 19 is a part-sectional view of a single plug.
Figure 20:
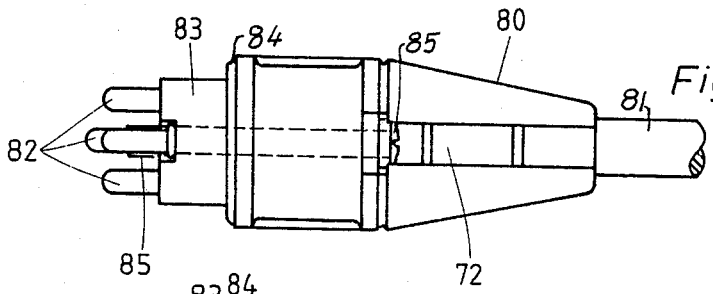
FIG. 20 is a top view of the plug of FIG. 19.
Figure 21:
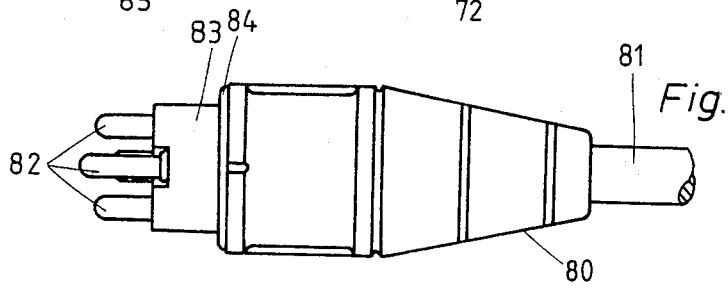
FIG. 21 is a bottom view of the plug of FIG. 19.
Figure 22:
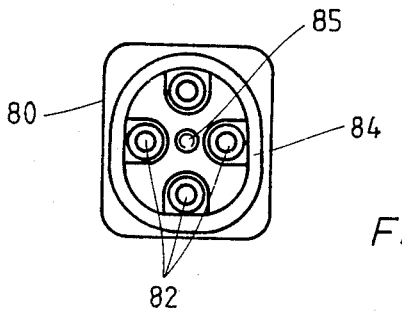
FIG. 22 is an end view of the plug of FIG. 19.

Those sockets 52 of the strips 50 which are not needed can be sealed against dampness or water, or other environmental contaminants by cover caps 62 (FIG. 9). Each cover cap has a projecting section 63, fitting in the respective well 59. A circumferential groove 64 is located in the region where the well 59 merges with the upper surface of the housing 56 (FIG. 6). A sealing ring 65 is located on the cover cap 62, the sealing ring being formed as an O-ring. Sealing ring 65 is seated in the region of the cover cap were the section 63 which fits in the well 59 merges with an overlapping flange region 66. The flange region is slightly bowed and matched to the contour of the sealing ring 65—see FIG. 11. A screw 67 is located in the center of the cover cap 62 which is secured by a C-ring 68 in axially positioned, loss-free arrangement. The screw 67 engages the threaded bushing 61. Upon tightening of screw 67, the sealing ring 65 is placed under compression between the flange 66 and the groove 64, and is deformed. Each cover plate 62 is formed with suitably located, for exaple diametrically located positioning or centering pins 73, which engage in associated contact sleeves or receptacle elements 60. The positioning elements 72 also provide for appropriate positioning of the cover cap 62, and insure fitting engagement in appropriately oriented direction.

The receptacle wells 59 and the fitting sections 63 of the cover cap 63 are unsymmetrical in cross section, for example non-round or otherwise non-symmetrical, e.g. oval. This is seen in the example as illustrated. The oval has two parallel longitudinal slides which are joined on one half by a curved line, which has a different radius of curvature from that of the opposite side. This arrangement permits insertion in only one predetermined direction. To facilitate orientation of the cap 62 and/or the respective plug, the housing 58 and the cap and/or the plug are formed with a locating notch 69, 70, respectively. Each plug 52 of the strip 50 has, additionally, two light-emitting diodes (LEDs) therein, combined as a single structural element 71—see FIGS. 6, 7.

Referring now to FIGS. 19–22, in which the details of the plug elements 80, fitting into the sockets 52, are shown: The plugs 80 are unitary elements, for example single plastic molded structures, which can be molded together with a connecting cable 81. The respective plugs have four projecting contact prongs 82 which are arranged in their orientation to fit the contact sleeves or receptacle elements 60 of the receptacles or sockets 52 of the plug-in strip 50. The contact prongs 82, for example in the form of pins which may be cylindrical, fit within the reception well 59 of the socket. The cross-sectional arrangement of the plugs is the same as that of the well 59, so that only one-way insertion is possible. The shaped region 83, fitting into the well 59, has the same shape as the section 63 of the cover cap 62. It includes a sealing ring 84 in form of a O-ring, which, like the sealing ring 65 of the cap 62, is located in a recess portion or groove immediately adjacent a projecting flange. The plugs 80, centrally of the contact prongs or pins 82, have a screw 85 which is threaded at least in the portion extending beyond the section 83 of the plug. The screw 83 is held in position so that it is axially essentially immovable—except for some slight play—and cannot be lost by a C-ring, as well known. Upon insertion of a plug 80 in an associated socket 52 of the connecting strip 50, the connection is fixed against possible loss by screwing-in the screw 85 within the threaded bushing or sleeve 61. The axial location of the screw 85 by means of a C-ring also insures that the plug is pushed outwardly, when it is intended to be removed, as previously described.

The plug 51 of the strip 50, the plugs 38 of the adapter elements 34, 35, as well as the single plugs 80 preferably have, each, one contact prong or pin which is longer than the remaining contact prongs or pins 53, 40, 82, respectively. The extended pin, which projects beyond those of the others, is provided for grounding connection within the cable. Thus, upon introduction of the plug into the socket, the entire arrangement is first grounded before any "live" connections are made; upon removal of the plug, grounding is retained until after the "live" connections have been broken, that is, when the shorter contact pins already have separated connections from the associated receptacle or socket elements.

The plugs are arranged to carry use identification or labels; for simplicity in the drawing, only the plug connector 20 is shown to include space for such identification.

A T-shaped holding groove 72 (FIG. 6) is located on the housing 58 of the plug-in distribution strips 50 at the location where the plug element 51 of the strip is to be inserted in the respective connector element 21, and, further, at the location of the four sockets 52. The holding groove 72 which, in cross section, is generally T-shaped, is provided to permit reception of a suitably matching designation label which can be slid from the open end into the groove. Similar holding grooves 72 are formed on the housing 39 of the adapter element 35 (FIG. 14); a holding groove 72 is associated with each plug 38. Coupling 11, as well as the single connecting plugs 80 (FIG. 20), likewise are preferably formed with a holding groove 72 for the labels.

The example selected—see FIG. 1—illustrates attachment of a distribution strip 50 to the upper right side socket 21 by engagement with the associated plug element 51 of the distribution strip 50. Two further distribution strips 50 are shown in broken line, to illustrate placement of other similar distribution strips. The two outermost sockets 52 of the distribution strip 50 are closed off by cover caps 62 to close the sockets against penetration of moisture or other possible contaminants. The cover cap 62 is take off one of the sockets 52 in order to illustrate the interior of the socket, the cover cap being flipped over to show the underside thereof. The illustration is in exploded form. The two open sockets 52 thus can be fitted with respective plug units 80. FIG. 1 additionally shows a plug unit 50 which is remotely connected from the distribution element 20, at the left side. The socket 21 on the plug distribution unit 20 has an adapter 34 attached thereto which is connected over the cable 13 to the coupling element 12. The socket 21 of the coupling element 12—see FIGS. 16–18—has the distribution strip 50 attached thereto by engagement with the plug 51 of the distribution strip 50. Respective single plugs 80—FIGS. 19–22—are attached to the distribution strip 50, connected over cables to loads which, for example, are shown schematically as three 3-phase motors M.

The distribution set permits rapid, easily supervised and visible installation and connection of multiple power supplies. The set is easily maintained and is particularly applicable for industrial installations where machinery is to be installed which may have to be moved. It can be located immediately adjacent the region of a machine to be installed, or a group of machines. The set permits connection of various electrical loads, such as motors, control panels, signaling elements, positioning units and the like which can be assembled to form an operative unit merely by plug-in connection of suitable plugs and sockets and tightening of the respective screws, such as screws 54 (FIG. 7), to provide a reliable connection without possibility of loosening, even under vibration or shock, which is tight against environmental conditions, and which can be readily severed, if required. The connection set can be secured directly on a distribution panel, for example at the side for easy accessibility, or can be remotely connected by a cable, such as cable 23. Installation, as well as maintenance and supervision of the appropriate connection, can easily be made by plant maintenance personnel, since no specific qualifications to make the connections are required. It is only necessary to provide a schematic connection diagram, in which the respective loads, such as the motors M, are shown. The connection diagrams can be supplied, for example, by the supplier of a system which is to be installed, for example including motors and associated control and sensing equipment; the diagram need only show the overall system arrangement, and where the respective connecting strips are to be inserted and connected as shown in the diagram. Additional internal wiring is no longer required.

Various changes and modifications may be made within the scope of the inventive concept. For example, the connecting prongs which are shown as circular pins, and the receptacle elements which are shown as matching sleeves, can be replaced by blade-type connectors with suitable receptacle elements, as well known in the electrical connection and distribution field.

Of the forty connecting elements of the connection plug 22, fitting into the respective receptacle sockets of the connection socket, twenty are provided to permit connection to different circuits, for example circuits of different power capability, or different respectively associated circuit breaker or fuse connection, as determined by the external connection of the cable 23, or an internal connection within the distribution panel; or the power distribution may be selectively arranged to supply single-phase a-c power at selected voltages, three-phase a-c power; d-c at selected voltages, and respective polarity with respect to ground, i.e. "ground positive" or "ground negative".

The forty-terminal plug 22 for connection to the plug distribution element 20 preferably has a terminal which is grounded, and connected to the metallic frame of the plug 22. The metallic frame of the plug 22 is, in turn, connected to a ground bus or ground terminal internally of the unit 20. The forty-one terminals—forty plug units and the ground connection formed by the metallic plug 22—permit $8\times4=32$ (thirty-two) terminals as input and output connection for control wiring and $4\times2=8$ (eight) terminals for current supply, selectively, a-c, single or three-phase, or d-c.

Each one of the sockets 52 has associated monitoring indicators, for example the LEDs 71. Preferably, two differently colored LEDs are associated with each such socket, for example a red LED and a green LED. The red and green units can be combined in one luminescent element, or located under one indicator glass.

The LEDs 71 are so arranged that, for example, when a plug 80 is introduced into a socket 51, and the respective plug is energized, that is, has power applied, the indicator will light. When a-c is supplied, both the green as well as the red LEDs 71 will be illuminated. By suitably polarizing the red and green LEDs, combined in one indicator, the red LED will light when d-c at positive-ground is supplied, and the green LED will light when negative d-c is supplied. Other connections, of course, are possible, for example all d-c being supplied at positive voltage with respect to ground, but switching being carried out, selectively, as customary in the positive or "hot" line, which will cause the red LED to light; if, however, switching is in the return or "negative" bus, the green LED will light. In case of misconnection, for example if a switch should have been placed in the positive line, but was not, the LED will provide an indication that the respective line is energized, thus preventing possible damage to a load which might be inadvertently connected, or possible injury. The LEDs thus form monitoring indicators to show proper polarization, and proper current flow as well as connection. Of course, the LEDs can also be suitably connected through a phase network to determine appropriate phase sequencing of respective terminals. The use of the indicators 71, thus, facilitates proper polarization of cables or other terminals or wires connected to the respective plug units. The indicators 71, additionally, indicate whether a certain plug unit or line is energized or not.

The respective circuits, as wired into the connection for the 40-terminal connector 20/22, are then distributed to various ones of the 7-prong sockets 21 on the connecting or bus plate 24 (FIG. 5) to allocate to the respective sockets 21 and their connecting receptacle elements appropriately phased connections, including one common ground or chassis terminal. The dimensioning of the sockets 21 can all be the same; if more power than that suitable for connection by one of the sockets 21 is needed, the dual socket adapter of FIGS. 12–14 or the multiple adapter 35*a* (FIG. 23), for example, may be used.

Some of the connecting terminals are used for signaling or control purposes, rather than for distribution of current at power levels; the connecting plug and socket elements themselves provide for reliable electrical connection between the interengaging matching elements, thus reliable transmission of control signals which may be of substantially lesser power, and thus more sensitive to terminal resistances than power connectors is insured. Suitable LED indicators, or other indicators, can be used, coupled to the respective terminals, as desired, to provide immediate visual indication of the type and/or polarity and/or phase to which the respective power terminals are connected, and if they are energized. Current flow through respective plug-socket terminals can be determined and indicated by suitable indicators and connected to current sensors of standard construction.

We claim:

1. Modular electric distribution connection set comprising a central distribution module having a plurality of electrical main terminals, the module including a box-like structure, the terminals being positioned essentially centrally thereof;

a plurality of identical modular multi-terminal connection sockets positioned on either side of the main electrical terminals, in aligned rows, each modular socket having a plurality of connection receptacle or socket terminals located in a predetermined configuration;

a conductor support plate having electrical connections thereon located inside the box and connecting selected ones of the main terminals with selected ones of the receptacle or socket terminals of the multi-terminal sockets, a remote socket element having a housing and a multi-terminal remote connection socket mounted therein identical to the modular multi-terminal connection sockets;

a plurality of modular plug units having a plurality of identical projecting prongs located in mirror image of said configuration, and being dimensioned and shaped to fit into said connection or socket terminals and being selectively connectable and disconnectable from the terminal connection sockets, said plug units including at least one each of:

an adapter element comprising a set of projecting prongs adapted to fit into one of the connection sockets for connection to a load;

a tandem plug unit having at least two sets of projecting prongs positioned to fit into the receptacle or socket terminals of at least two adjacent sockets and adapted for connection to a selected external load;

and a distribution strip having a housing structure and, secured to said strip, a distribution plug unit identical to any one of said plurality of separable plug units, and including, within said housing structure, a distribution conductor support plate having electrical conductors thereon, the housing structure further comprising a plurality of power distribution sockets each having a plurality of plug-in terminals, wherein the plurality of plug-in terminals comprises a lesser number of terminals than the number of terminals of said connection receptacle or socket terminals, the plug-in terminals being connected electrically to the electrical connections on the distribution conductor support plate;

and wherein each of said sockets and each of said plug units includes interengaging threaded bolt-and-sleeve elements, one of said elements being located on the socket, and the other of said elements being located on the plug unit, one of said elements being rotatable and axially essentially fixed to provide for screw-in engagement of plug units with respective sockets while insuring positive ejection of plug units from the sockets upon turning of the respective rotatable element in removing direction.

2. Set according to claim 1, further including closing-off cover caps provided for each one of the sockets;

projecting prongs extending from the cover caps and fitting into the receptacle or circuit terminals of the sockets;

and wherein the sockets include, each, at least one internally threaded bushing or sleeve, and the cover caps include screws having matching threads, positioned for screw-in connection with the threaded sleeve or bushing, the screws being rotatably and axially essentially immovably retained in the cover caps to provide for tightening of the cover caps towards the socket, and forcible ejection of the cover cap, and the locating pins therewith, upon rotation of the screws in a direction of removal of a respective cover cap.

3. Set accoring to claim 1, wherein the multi-terminal connection sockets include seven connection receptable or socket terminals, one of said seven terminals being a ground or chassis terminal.

4. Set according to claim 1, wherein the plug units of the set include a coupling unit having one of said adapter elements on one portion thereof, and a multi-terminal connection socket identical to the sockets of said plurality of adjacently located multi-terminal connection sockets on another portion thereof, the projecting prongs and the receptacle or socket terminals of the plug unit and the socket being connected in electrically aligned polarized configuration.

5. Set according to claim 1, wherein said distribution box includes a front panel;

a sealing gasket located on the front panel and having openings leaving exposed the multi-terminal connection sockets and surrounding said sockets secured to said front panel.

6. Set according to claim 5, wherein said set further comprises severable cover caps having projecting locating elements fitting into selected ones of said receptacle or socket terminals;

an an interengaging bolt-and-sleeve element for forming a thread connection with that one of the elements located on the socket for releasably connecting a cover cap over a socket, but permitting tightening of the cover cap against the seal.

7. Set according to claim 1, further including visible indicator means comprising light-emitting diodes (LEDs) located opposite respective sockets of the distribution strip.

8. Set according to claim 1, at least one of: the housing; the housing structue of the strip are formed with surface-adjacent slots having, in cross section, approximately T shaped, positioned adjacent and in association with respective sockets, to form a reception element for an identification label or strip.

9. Set according to claim 1, wherein the housing structure of said strip comprises an elongated, essentially box-like structure having a depth matching, at least approximately, the depth of the central distribution module;

and wherein the plug unit on the housing structure is positioned at one end portion of the elongated housing structure, for overlapping engagement with one of said multi-terminal connection sockets, the power distribution sockets being located in adjacent alignment along the housing structure to permit attachment of the plug unit of the housing structure to one of the multi-terminal connection sockets and provide for lateral extension of the housing structure of the distribution strip from the central distribution module with the power distribution sockets in essentially linear, readily observed alignment.

10. Set according to claim 9, wherein the distribution conductor support plate and the electrical distribution conductors thereon are common to all the power distribution sockets and the distribution conductors are connected to selected ones of the projecting prongs of the plug unit.

11. Set according to claim 9, wherein the box-like structure has a top panel;

and the power distribution sockets are located in the housing, recessed from and accessible through the top panel, the prongs of the plug unit of the strip extending parallel to the recesses for the distribution sockets.

12. Set according to claim 11, wherein the power distribution sockets are positioned on the bottom of a well to provide for said recess positioning thereof;

and wherein the cross-sectional shape of the well is non-symmetrical with respect to at least one direction thereof to provide for single-fit positioning of a plug element into the well, the plug element having projecting portion having a cross-sectional shape matching the cross-sectional shape of the well.

13. Set according to claim 12, further comprising separable cover caps shaped to fit over and completely cover the wells of the distribution sockets;

locating pins projecting from the cover caps for positioning of the cover caps over the well in oriented alignment;

and releasable screw connection means for clamping the cover caps over the wells and sealingly retain the cover caps thereagainst.

14. Set according to claim 13, wherein the well has a terminal region formed with a sealing ring receiving groove.

* * * * *